US012196062B2

(12) United States Patent
Watts et al.

(10) Patent No.: US 12,196,062 B2
(45) **Date of Patent: *Jan. 14, 2025**

(54) BEHIND CASING WASH AND CEMENT

(71) Applicant: CONOCOPHILLIPS COMPANY, Houston, TX (US)

(72) Inventors: Rick Watts, Houston, TX (US); Stein Haavardstein, Tananger (NO); Lars Hovda, Tananger (NO); James C. Stevens, Bartlesville, OK (US); Dan Mueller, Houston, TX (US); Brett Borland, Houston, TX (US); Amal Phadke, Houston, TX (US); Praveen Gonuguntla, San Antonio, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/116,744

(22) Filed: Mar. 2, 2023

(65) Prior Publication Data

US 2023/0228173 A1 Jul. 20, 2023

Related U.S. Application Data

(60) Continuation of application No. 17/462,598, filed on Aug. 31, 2021, now Pat. No. 11,608,718, which is a (Continued)

(51) Int. Cl.
*E21B 41/00* (2006.01)
*E21B 33/14* (2006.01)
(Continued)

(52) U.S. Cl.
CPC ..... *E21B 41/0078* (2013.01); *E21B 33/14* (2013.01); *E21B 37/00* (2013.01); *E21B 37/08* (2013.01)

(58) Field of Classification Search
CPC ..... E21B 41/0078; E21B 37/00; E21B 33/14; E21B 37/08
See application file for complete search history.

(56) References Cited

U.S. PATENT DOCUMENTS 3,052,298 A 9/1962 Malott
4,441,557 A * 4/1984 Zublin ..... E21B 37/00 166/73

(Continued)

OTHER PUBLICATIONS

Ferg, T., et al—"Novel Approach to More Effective Plug and Abandonment Cementing Techniques", Society of Petroleum Engineers Artic and Extreme Environments Conference, Moscow, Oct. 18-20, 2011 (SPE #148640), pp. 1-13; 13 pgs.

(Continued)

*Primary Examiner* — Brad Harcourt
(74) *Attorney, Agent, or Firm* — CONOCOPHILLIPS COMPANY

(57) ABSTRACT

The invention relates to a method of conducting a perf wash cement ("P/W/C") abandonment job in an offshore oil or gas well annulus (2), in particular the washing or cementing operation using a rotating head (6, 8) with nozzles (7, 9) dispensing wash fluid or cement at pressure. Certain values of parameters of a washing or cementing job have been found surprisingly to affect the quality of the job, or the degree to which they affect the quality of the job has been unexpected. These include including rotation rate of the tool, the direction of translational movement of the tool, and the volume flow rate and pressure per nozzle of cement or wash fluid (and hence nozzle size).

19 Claims, 5 Drawing Sheets

Related U.S. Application Data division of application No. 16/529,892, filed on Aug. 2, 2019, now Pat. No. 11,136,862.

(60) Provisional application No. 62/713,629, filed on Aug. 2, 2018.

(51) Int. Cl.
*E21B 37/00* (2006.01)
*E21B 37/08* (2006.01)

(56) References Cited

U.S. PATENT DOCUMENTS 5,060,724 A 10/1991 Brammer et al.
5,161,612 A * 11/1992 Stafford ..... E21B 41/0078 166/171
7,314,083 B1 * 1/2008 Martini ..... E21B 37/00 166/170
11,608,718 B2 * 3/2023 Watts ..... E21B 37/08
2004/0074645 A1 4/2004 Surjaatmadja
2012/0312539 A1 * 12/2012 Glass ..... E03B 3/15 166/222
2014/0231546 A1 * 8/2014 Etschel ..... E21B 37/06 239/245
2016/0194937 A1 7/2016 Myhre et al.
2016/0341017 A1 * 11/2016 Fu ..... C09K 8/52

OTHER PUBLICATIONS

International Search Report for PCT/US2019/044788 mailed Oct. 28, 2019; 3 pgs.

* cited by examiner

BEHIND CASING WASH AND CEMENT

CROSS-REFERENCE TO RELATED APPLICATIONS

This application is a continuation application which claims benefit under 35 USC § 120 to U.S. application Ser. No. 17/462,598 filed Aug. 31, 2021, entitled "BEHIND CASING WASH AND CEMENT" which claims benefit under 35 USC § 120 to U.S. application Ser. No. 16/529,892 filed Aug. 2, 2019, entitled "BEHIND CASING WASH AND CEMENT" which claims benefit under 35 USC § 119(e) to U.S. Provisional Application Ser. No. 62/713,629 filed Aug. 2, 2018, entitled "BEHIND CASING WASH AND CEMENT" which are incorporated herein in their entirety.

STATEMENT REGARDING FEDERALLY SPONSORED RESEARCH

None.

FIELD OF THE INVENTION

This invention relates to the process of washing and cementing behind the casing of a well, for example in a so-called perf, wash cement well decommissioning operation.

BACKGROUND OF THE INVENTION

In a process for placing cement in the annulus of a well, normally the annulus between casing and wellbore (e.g. in a perf, wash cement well abandonment operation), there are three distinct steps:

- Opening the casing (explosive, mechanical, abrasive or melt based perforation)
- Washing the annulus between casing and wellbore
- Displacing in plugging material (e.g. cement).

There are currently two basic versions of the wash stage of the perf, wash, cement ("P/W/C") procedure. The first (the cup technique) involves having upper and lower cup-like sealing elements seal off a length of opened/perforated casing and then passing wash fluid to the region between the cups such that it is forced out through the openings or perforations. With the cup technique, the perforation area is part of the design and the wash fluid is forced under relatively steady pressure. The cup technique is accurately described in Ferg, T., et al "Novel Techniques to More Effective Plug and Abandonment Cementing Techniques", *Society of Petroleum Engineers Artic and Extreme Environments Conference, Moscow,* 18-20 Oct. 2011 (SPE #148640). The cup technique suffers from the disadvantage that it will often induce loss to the formation. This because the formation in any given position has a material strength. The combined load from the wash fluid (the hydrostatic pressure) and the wash process (the dynamic pressure) must always be lower than the formation material strength, or downhole losses will occur.

The second type of wash technique is the so-called jet technique, where jets of wash fluid are emitted from a rotating wash tool within the casing. The jet technique will be most effective in the annulus when an open perforation is hit by a jet, consequently the open area in the casing will have a large effect on the wash effect.

Following the wash, the setting of plugging material (cement) behind the casing is the next step in the process.

There are at least 4 alternative techniques for displacing the annulus content (wash fluid or "spacer fluid") to cement: a) using a technique similar to the cup type wash process described above, b) using a technique similar to the jet wash process described above, c) bull head the cement from casing to annulus by adding a pressure exceeding the formation material strength or d) "pumping" in from casing to annulus by a screw or axial propeller. Methods a, b and d involve moving the workstring and treating a section at the time; method c treats the entire perforated length at instantly. Methods b and d can also be combined.

This process will be referred to a "cementing" and the plugging material as "cement" but it is to be understood that it is not necessarily limited to the use of cement and any suitable plugging material could be employed; the terms "cement" and "cementing" should be understood accordingly.

The jet technique version of P/W/C is not always successful and the reasons for this are not fully understood. Jets of wash fluid are "directed" behind the casing according to current prevailing theory. Variables in the process such as fluid pressure, volume and rheology are set based on a guess of what will produce a suitably directed jet of sufficient power, according to the prevailing theory, to pass through the perforations and clean behind the casing.

If using cement technique (d) as outlined above current prevailing theory regarding cementing is that the cement should be squeezed or washed through the openings in the casing by using an axial screw arrangement. Cement bond logging to verify results have shown that cement is not delivered efficiently and the reasons for this are not fully understood.

There are many variables which may affect the outcome of the wash and cement operations. The setting of these variables is currently a matter of guesswork and it is not currently possible to perform a P/W/C job and be confident that an adequate plug has been set. The current industry standard to verify the result is to "drill out and log" (outlined in SPE paper #148640). This involves drilling out the cement inside the casing and then passing a logging tool down which can assess the quality of the cement bond behind the casing. If it is adequate, then the interior of the casing can be re-cemented. This is a costly process; it will typically require 2 rig days to drill out, log, verify results, re-cement and test the new cement inside the casing again. A failed job can be repeated in the same interval; it can potentially be repeated at a different depth or alternative methods may be selected. Generally, the jet type technique is not as sensitive to annulus content as the cup type technique due to lower dynamic pressure contribution as outlined above, nevertheless success in the first attempt is vital for cost efficiency.

BRIEF SUMMARY OF THE DISCLOSURE

The inventors have realized or conceived of a number of things which had not previously been appreciated regarding jet type washing in a P/W/C operation. They believed that any of a variety of factors such as the distance between the wash head and the inside wall of the casing, the number and size of perforations in the casing, the JET dissipation, the weight and rheology of the washing fluid, the weight, rheology or compressive strength of the annulus content, the work string RPM and movement, the hole angle, the original borehole effective ID, the flow and size of or over nozzles, the nozzle design and the perforation pattern may affect how efficient the jet effect is, and therefore the efficiency of the wash. However, they were uncertain which of these parameters may be more significant and also, of course, uncertain as to what level any significant parameter should be set at. These factors will be referred to as amplitude parameters, and the amplitude parameters may have a similar role in the subsequent operation of setting cement/plugging material which is a comparable exercise. The inventors were also uncertain of the phenomenon of cavitation would affect the jet washing operation.

One way to replace the practice of setting of the parameters of a wash (or cement) job based on a "hunch" (and then possibly drilling out and logging the job) is to perform physical onshore tests or use computer modelling.

The inventors have performed a considerable amount of computational fluid dynamic (CFD) work and have verified this CFD modelling by re-creating a high pressure environment in onshore test apparatus to test at least some of the amplitude parameters in this environment under different conditions.

The inventors have also appreciated that the conventional understanding of the wash process in terms of directing jets of wash fluid through perforations and into the annulus is flawed. This is partly because the jets from the nozzles will have very different characteristics when in a high-pressure liquid environment. In fact, the inventors believe that the correct understanding of the process should be in terms of a pressure pulse. The pulse may be a function of at least some of the amplitude parameters outlined above, possibly in combination with the length of the pulse, which is likely to be a function of perforation size and angular velocity. Due to pressure-dependent cavitation the amplitude should be determined in a range of environment pressures.

The inventors also believe that the cementing process will be efficient if cement is driven into the casing annulus by a pulse-energize-accelerate-flow-displacement of wash fluid process rather than a squeeze or flow from an axial screw arrangement. The inventors therefore believe that the current procedure of rotating the string to drive an axial screw impeller to squeeze cement is probably not effective.

The inventors believe that "jet" efficiency from a nozzle must be mapped in a high pressure "in situ" environment to establish "jet" dissipation and effective range in a liquid-liquid interface at high ambient pressure, including the effect of cavitation, and this can then support CFD modelling which may be used to explore many more options for various parameters.

Many perf wash cement (PWC) jobs in the past have been performed using parameters based on "hunch". The standard parameters for the current qualified (prior art) technique include, for wash fluid:

(a) a nozzle pressure of about 2000 psi;
(b) a volume flow rate through each nozzle of about 9 to 18 gal/min
(c) a rotation rate of wash tool of about 6-10 r.p.m.
(d) an open area of casing, i.e. the percentage of the casing which is perforated, of 3.92-4.71
(e) nozzle aperture size of 4/32, or sometimes 5/32 inch or a mix of the two sizes
(f) number of nozzles normally from 25 to 30
(g) translational speed of wash head from 0.2 to 0.5 ft/min
(h) direction of wash: repeated up and down movement (distal and proximal movement)

The standard parameters for the current qualified (prior art) technique include, for cement:

(a) a volume flow rate through each nozzle of 25 to 35 gal/min,
(b) nozzle aperture size of 8/32 inch
(c) number of nozzles: 4
(d) an open area of casing, i.e. the percentage of the casing which is perforated, of 3.92-4.71.

The open area of casing value refers to the region of casing which is perforated, measured from the top (most proximal) to bottom (most distal) of the perforations. The summed area of all the perforations is then expressed as a fraction or percentage of the total area of the perforated region of casing, in its original unperforated state. Either the inner or outer surface of the perforated region of casing may be used for this calculation, provided the area of the casing and the area of the perforations are both calculated based on the same side of the casing (outer or inner), since the percentage is likely to be very similar in either case.

Current accepted practice for the washing process is to dispense wash fluid under pressure whilst moving the wash tool several times up and down the section of wellbore to be washed.

Certain parameters which are relevant to the efficiency of a wash and/or cement process are at least to some extent beyond the control of the operators, such as the content of the annulus, the maximum total flow rate (set by the capability of standard rig pumps), the density/viscosity/rheology of the wash fluid (since it is normally drilling mud of whatever specification is being used for the job, set by other considerations, the distance between the jetting nozzle tip and the wellbore wall (controllable to some extent only). Ranges for some of these non-controllable parameters are:

(a) Drilling mud density between 8 and 17 pounds per gallon
(b) Drilling mud viscosity between 10 and 60 cP
(c) Distance between nozzle tip and wellbore wall between 1 and 16 inches
(d) Ambient pressure between 1,000 and 7,000 psi

BRIEF SUMMARY OF THE DISCLOSURE

No onshore test rig existed (to the inventors' knowledge) suitable for this task. Therefore the inventors have conceived and designed an unusual test rig which comprises a cell containing liquid, optionally together with solids, at high pressure, to simulate the actual conditions downhole. Test have been conducted using this apparatus using one nozzle jetting fluid at a plate to simulate the wellbore wall. In addition a large amount of CFD modelling has been done, and the physical tests results used to corroborate the CFD results. In general, the CFD results have been shown to be remarkably accurate.

Some of the results of this work have been very surprising. For example, the inventors had thought that a relatively slow rate of rotation of the jetting tool would be effective since it would produce longer pulses of pressure in the annulus which, having a higher total energy content, would be effective to energize the annulus content. However, it has in fact been found that a higher rate of rotation, producing a larger number of shorter (and hence less energetic) pulses can be considerably more effective.

Another surprising result has been that the direction of longitudinal movement of the tool in the well may have a large influence on the effectiveness of the wash. It appears that, if washing is performed in an upward direction, debris may be displaced upwards in the annulus and then fall back down, negating the effect of the wash. The inventors believe therefore that washing whilst displacing the tool downwards is much more effective and in fact it may be sufficient to make only a single downward pass of the wash tool.

Finally, the inventors have found that the current volume flow rate and pressure drop for each nozzle may be inadequate to energize effectively the content of the annulus. The total fluid flow rate (whether it be wash fluid or cement) is, at least as things stand today, set by the pumps and other equipment on the rig. Current procedure for wash and cement is to use a relatively large number of 4/32 inch diameter nozzle apertures, resulting in a certain flow rate per nozzle and a certain pressure drop across each nozzle (for a given type of drilling mud used as wash fluid, or a given specification of cement). The inventors have found that the pressure drop across each nozzle may need to be considerably higher than this for washing or cementing to be effective, and the volume flow rate for each nozzle also may need to be higher. For this reason, the inventors believe that a smaller number of nozzles with larger apertures (e.g. 6/32 inch may be more effective. However, the energy of the pressure pulse produced by each nozzle should not be too high, the inventors believe, or the pulse may break down the wellbore wall, which is highly undesirable.

According to the invention, a method of performing a downhole wash procedure in an offshore well is provided. According to a second aspect of the invention, a method of performing a downhole cementing procedure in an offshore well is provided. The advantages of these methods will be apparent from the following description of various embodiments and examples of test procedures.

According to a third aspect of the invention, a method of performing a downhole wash procedure in an offshore well in a region of casing having perforations or other openings is provided, the method comprising:

passing a washing tool down the casing to the region with perforations or openings, the washing tool having a plurality of nozzles and being connected to a supply of wash fluid;

delivering wash fluid through the nozzles whilst rotating the washing tool and translating the washing tool in an axial direction with respect to the casing, such that wash fluid is forced through the perforations and pulses of pressure are created in an annulus between the casing and the rock formation of the wellbore, wherein the rotation speed of the wash tool whilst delivering wash fluid is from 40 r.p.m. to 150 r.p.m, including approximately 40 r.p.m., 50 r.p.m., 60 r.p.m., 70 r.p.m., 80 r.p.m., 90 r.p.m., 100 r.p.m., 110 r.p.m., 120 r.p.m., 130 r.p.m., 140 r.p.m., and 150 r.p.m, optionally from 40 r.p.m. to 120 r.p.m., optionally from 60 to 120 r.p.m., optionally 70 to 120 r.p.m., optionally 70-80 r.p.m.

Optionally, in the third aspect of the invention, the perpendicular distance from an outlet of each nozzle to an interior wall of the casing is from 0.1 inch to 1 inch. Optionally, in the third aspect of the invention, whilst delivering wash fluid, the translational movement of the washing tool is in a downward (distal) direction only. Optionally, the rate of downward movement is from 0.1 feet/min to 4 feet/min, optionally between 0.5 feet/min and 2 feet/min, preferably about 1 foot/min. Optionally, the wash fluid is delivered in a single downward (distal) pass of the washing tool In a fourth aspect of the invention, a method is provided for performing a downhole wash procedure in an offshore well in a region of casing having perforations or other openings, the method comprising:

passing a washing tool down the casing to the region with perforations or openings, the washing tool having a plurality of nozzles and being connected to a supply of wash fluid;

delivering wash fluid through the nozzles whilst rotating the washing tool and translating the washing tool in an axial direction with respect to the casing, such that wash fluid is forced through the perforations and pulses of pressure are created in an annulus between the casing and the rock formation of the wellbore; wherein whilst delivering wash fluid, the translational movement of the washing tool is in a downward (distal) direction only. Optionally, the rate of downward movement is from 0.1 feet/min to 4 feet/min, optionally between 0.5 feet/min and 2 feet/min, preferably about 1 foot/min. Optionally, the wash fluid is delivered in a single downward (distal) pass of the washing tool.

Finally, in connection with all four aspects of the invention and their respective optional features, the casing diameter may be 10¾ inch, 9⅝ inch or 7¾ inch diameter, optionally 10¾ inch or 9⅝ inch diameter.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The current known technique for a perf wash cement ("P/W/C") procedure for decommissioning an offshore oil or gas well will be described with reference to FIGS. 1 to 3.

Figure 1:
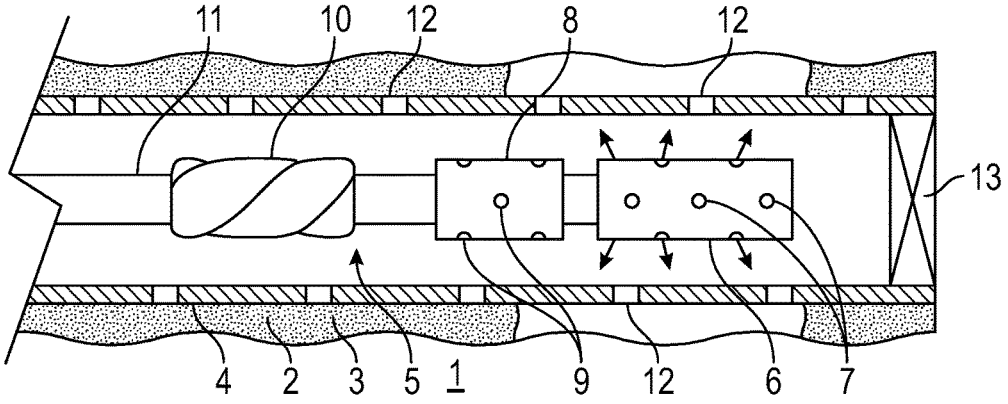
FIG. 1 is a schematic cross section of a wellbore showing a wash operation according to the prior art.
Figure 2:
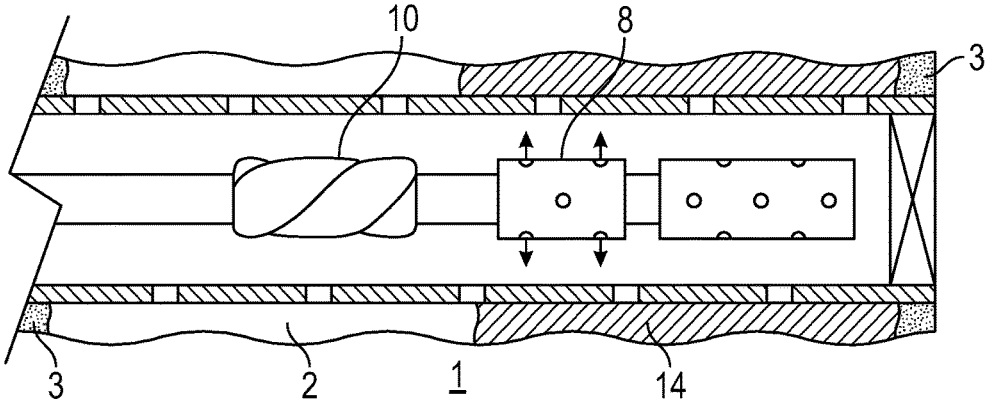
FIG. 2 is a schematic cross section of a wellbore showing a cementing operation according to the prior art.

Referring firstly to FIG. 1, a section of an offshore oil or gas well is shown. Between the rock formation 1 and casing 4 is an annulus 2 filled with oil or other fluids and debris, the annulus content being generally designated at 3.

Within the casing 4 is shown part of a P/W/C bottom hole assembly 5. The assembly comprises a wash tool 6 with wash nozzles 7. Above the wash tool 6 is a cementing tool 8 with cementing nozzles 9. Above the cementing tool is an axial screw impeller element 10. The wash tool, cementing tool and impeller element are all mounted on, and rotate with, a workstring 11.

FIG. 1 shows the well with the "perf" stage of the P/W/C operation completed, leaving perforations or apertures 12 at regular intervals in the casing, and a packer or plug 13 set underneath the perforated region of casing. Perforations are made with a perf gun similar to that used for completion operations. Either 18 shots per foot or 20 shots per foot are fired over the perforated section, resulting in an open area of approximately 4% in the perforated section.

FIG. 1 shows the wash stage of the process, in which wash fluid, commonly drilling mud of some sort, is jetted out of wash nozzles 7 to achieve a wash effect behind the casing, removing the accumulated fluid and debris 3 and replacing it with wash fluid. During this process, the workstring rotates at a few r.p.m., often about 10 r.p.m. and is normally moved up and down the perforated region of casing Referring now to FIG. 2, the annulus 2 has now been substantially cleaned of residual fluid and debris and the cementing tool 8 is now dispensing cement into the well. Cement is shown at 14 partly filling the annulus, having passed through perforations 12. The axial impeller 10 rotates inside the casing with the workstring and helps to force cement through the perforations 12.

During the cementing stage of the process, the workstring rotates much faster, at 80 r.p.m. or above, which is considered necessary to make the impeller 10 effective.

Figure 3:
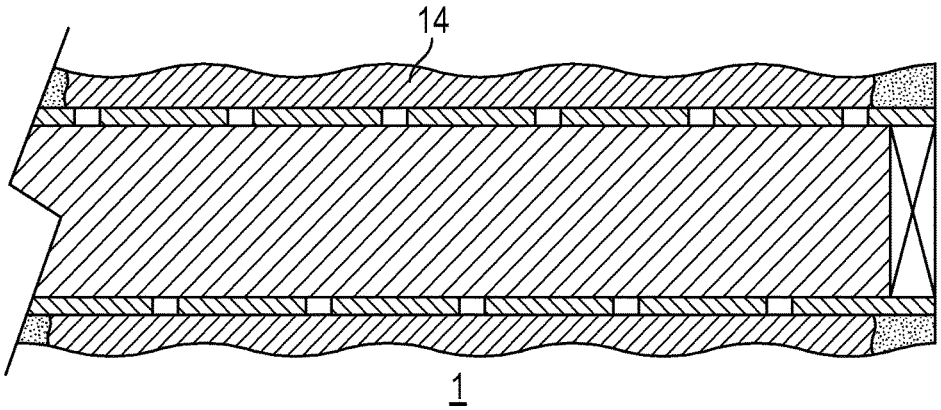
FIG. 3 is a schematic cross section of an effectively cemented wellbore.

Finally, in FIG. 3, the annulus is shown filled with cement with no voids and a good bond between the casing and cement. The interior of the casing is also filled with cement and the P/W/C tool has been removed. This is the desired outcome of a P/W/C operation. However, often the outcome is not sufficiently good.

As things stand at present, P/W/C jobs are not reliable and therefore after the job, the cement within the casing has to be drilled out. A logging tool is then passed down the inside of the casing, which is able to detect whether the cement bond in the annulus is of sufficient quality.

Little detailed information is known of a jet's actual shape and behavior in a very high pressure fluid environment, but nonetheless the inventors believe this high pressure environment can be simulated in a specially designed test cell onshore.

Example 1

Figure 4:
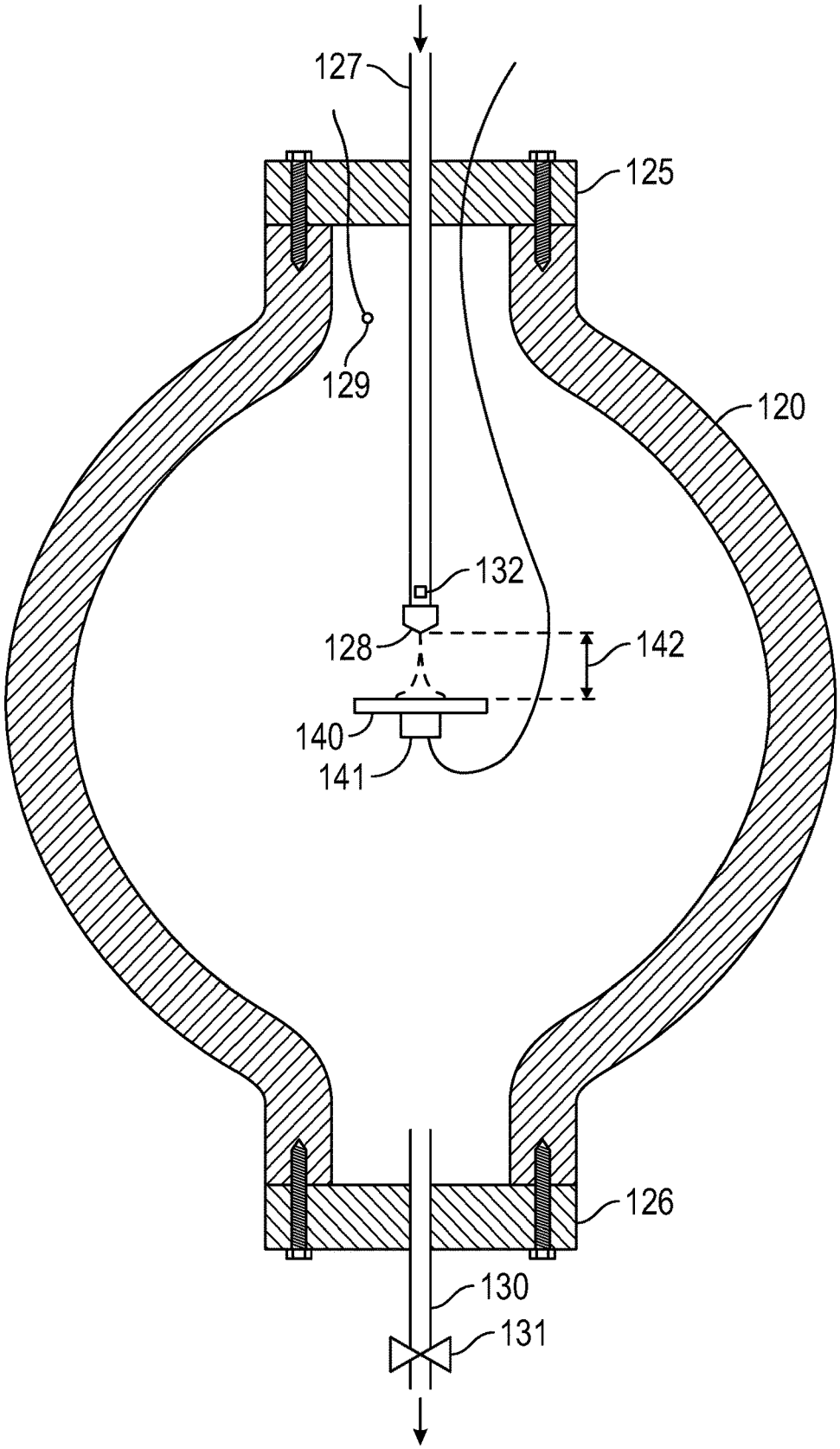
FIG. 4 is a schematic cross section of a pressurized test chamber used for verifying CFD work.

Referring now to FIG. 4, a number of tests were conducted using a high pressure chamber 120, capable of withstanding internal hydrostatic pressure in excess of 10,000 psi. The chamber was filled with water (to simulate the fluid in the casing and in the well annulus).

The pressure chamber 120 was fitted with upper and lower end plates 125, 126. Passing through the upper end plate 125 was a conduit 127 terminating in a nozzle 128 inside the pressure chamber 120. Facing the nozzle 128 and spaced from it was a plate 140. The distance between the plate 140 and nozzle 128 can be varied remotely from outside the chamber, by means not shown. The plate was mounted on a force/deflection sensor 141 which was located on the opposite side of the plate to the side facing the nozzle 128.

A pressure sensor 129, with associated lead passing through the upper end plate 125 to display or monitoring apparatus (not shown), was arranged to detect the ambient hydrostatic pressure in the chamber 120 so that this could be monitored and controlled. An exit channel 130 and pressure regulating valve 131 were provided to help regulate ambient pressure. A jet static pressure sensor 132 was located in the channel 127.

In a series of tests, water was passed down the conduit 127 at pressures above ambient, and the force of the resulting jet from the nozzle impinging on the plate 140 measured using the force sensor 141. The ambient pressure was controlled to be approximately constant, within a fairly wide tolerance. The pressure drop across the nozzle 128, volume flow rate of fluid through the nozzle, size of nozzle orifice and distance of the plate from the nozzle were all varied in different test runs.

Pressure drop across the nozzle was calculated using a standard technique based on pressure of the supply on one side and on the other side sensed ambient pressure together with a dynamic pressure calculation based on volume flow rate of supply and area of nozzle.

The purpose of the tank tests was firstly to establish some things about the behavior of a pressure jet passing through a liquid at the level of ambient pressure encountered in a wellbore at the depth at which a cement abandonment plug must be set. It was determined that, at these ambient pressures (anything over about 150 psi in fact), cavitation effects are insignificant and can be ignored. It was also determined that, at these pressures, variations in the ambient pressure have little effect on jet dissipation and dampening.

Figure 5:
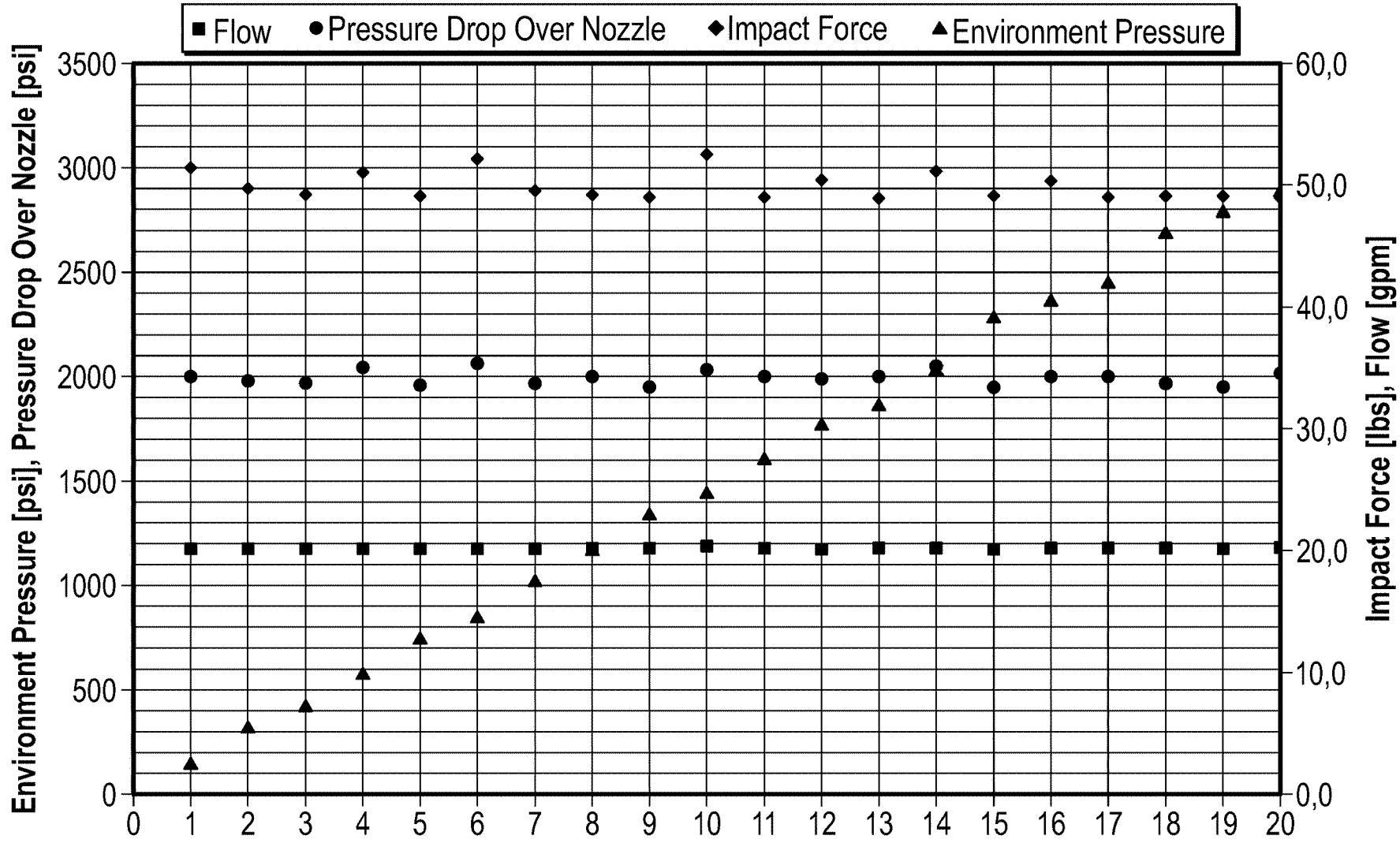
FIG. 5 is a graphic presenting some results of pressure tank testing in which nozzle pressure drop and volume flow rate were held constant and ambient tank pressure adjusted.

Some of the results are presented in FIG. 5. In these tests the pressure drop across the nozzle was maintained at approximately 2000 psi and the volume flow rate was maintained at 20 gal/min. The clearance between the plate and the nozzle tip was maintained at 4.2 inches, whilst the ambient pressure was increased gradually from about 150 psi to about 2800 psi. This clearance was intended (very broadly) to represent the distance between the nozzle tip and the rock wall. Over the 20 tests, it can be seen from FIG. 5 that, as the ambient pressure increases (triangle symbols), the impact force (diamond shaped symbols) remains essentially constant. From this test it can be deduced that cavitation effects have essentially no effect on the force imparted by the jet at ambient pressures above about 150 psi.

The second purpose of the tank tests was to verify that the CFD modelling referred to below was giving an accurate description of the jet and its energy. Measurements of force on the plate were made for different volume flow rates, nozzle sizes and clearances between plate and nozzle tip. The results are tabulated in Table 1 below (see Example 2).

Example 2

The pressure tank, nozzle and plate arrangement of Example 1 was modelled in computational fluid dynamics (CFD) software and then tests run in the CFD software. The purpose of these tests was principally to compare the results to determine if the CFD testing accurately reflected the physical tests in the pressure tank.

The CFD modelling in this and other examples below employed software marketed under the trade name "Fluent" by Ansys Inc. Key results from these CFD tests are shown in Table 1 below, side by side with equivalent results from the physical tank test of Example 1. The correlation is good. The term "clearance" in this table refers to the distance between the nozzle tip and the pressure plate.

TABLE 1

| Nozzle Size | Clearance | Flow Rate (gpm) | Force on Plate (lbs) Tests | Force on Plate (lbs) CFD |
|---|---|---|---|---|
| 4/32" | 4.2" | 20 | 49.2 | 49.4 |
| | | 30 | 113.5 | 111.3 |
| | 16" | 20 | 23.6 | 22.0 |
| | | 30 | 55.1 | 48.9 |
| 6/32" | 16" | 30 | 28.9 | 22.5 |
| | | 37 | 38.8 | 33.1 |

Example 3

Further CFD work was then performed using a much more detailed CFD model which included a wash tool with more than one nozzle located within a perforated casing directing jets outwardly into an annulus. One foot long sections of industry standard 9% inch diameter casing were modelled with either 18 or 20 perforations of either 1 inch or 1.4 inch diameter. For this test, the annulus fluid was modelled as a viscous medium including solid debris, similar to the expected contents of a real annulus. Although the content of an annulus can vary widely, the modelled annulus content was considered to be almost a "worst case", unless the content of the annulus was compacted solid material which would not behave like a fluid at all. In the latter event it would be expected that this compacted volume would become part of the final cemented seal.

The CFD model was a realizable k-e turbulence model in the Fluent software, using a scalable wall function with appropriate Y+ value to capture wall boundary effects. Debris and wash fluids were modeled as non-Newtonian fluids: Bingham plastic model for wash fluid (water based mud), Herschel-Bulkley model for debris fluid (old mud). All fluids were considered homogeneous. The computational timestep was 10-3 s (typical) adjusted for optimum numerical stability and tool rotational speed.

A one foot long perforated section of casing was modelled. A hex mesh was used with a cell count of approximately 5 million, maximum skewness less than 0.7. The moving wash tool was modelled using a moving mesh motion. All perforations in the casing were assumed to be circular with no burr. A mass boundary flow condition was applied at the inlet and a pressure boundary condition at the outlet.

A large number of combinations of different parameters were tested using the CFD model. Some were found to have a large effect on the efficacy of the process, others less of an effect. In some cases these results were very unexpected. The efficacy of the wash process was judged in the main part by assessing the volume fraction of the annulus occupied by wash fluid instead of the original annulus content after the wash tool had passed through the 1 foot long modelled section of wellbore and casing. Parameters that were varied included: total wash fluid flow rate, number of nozzles, size of nozzles, pressure drop across each nozzle, size and number of perforations in casing, stand off distance (distance between nozzle tip and inner casing wall), rotation speed, speed of axial movement of wash head, direction of axial movement of wash head.

The results are impractical to present numerically, but images and animations were produced showing the volume fraction of original annulus fluid and fluid from the nozzles in the annulus as predicted by the CFD model. These images were interpreted by both oilfield engineers and CFD experts to decide what would be likely to result in an effective annulus washing operation. In addition, numerical results indicating the percentage of the annulus volume displaced wash fluid vs time were calculated. This gave a measure of performance by indicating the amount of debris remaining in the control volume as a function of time.

Figure 6:
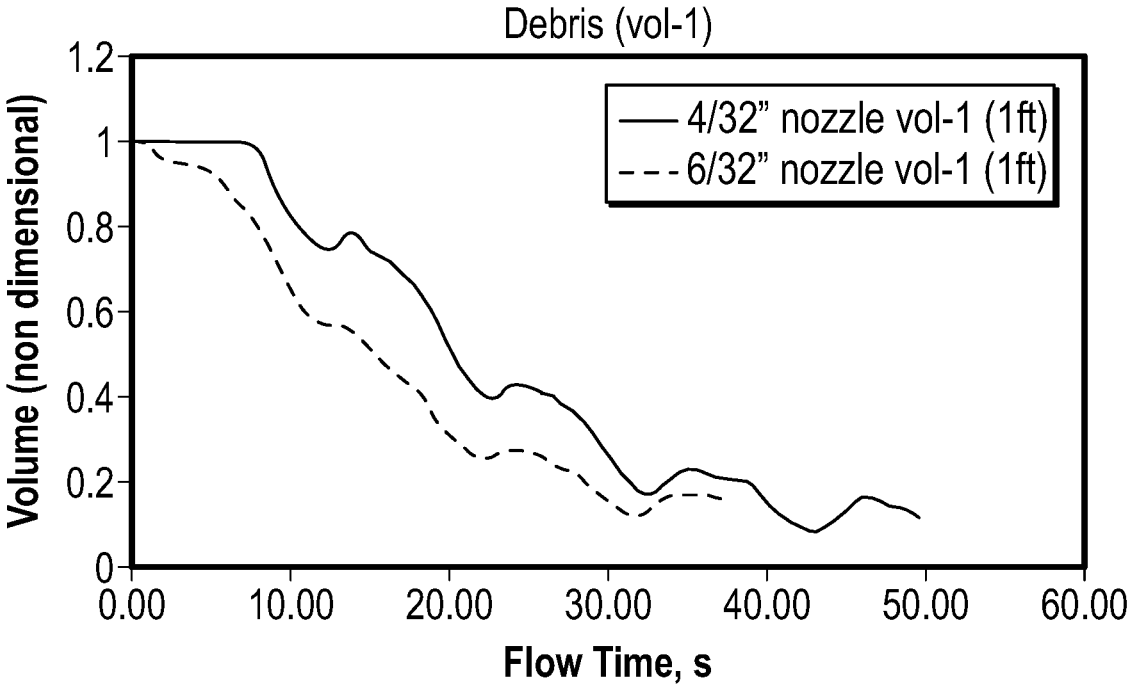
FIG. 6 is a graphic result from CFD testing showing a comparison between a wash process using 6 4/32" nozzles vs a process using 3 6/32" nozzles.

In one run a comparison was made between washing with 6 nozzles each having a 4/32 inch diameter (circular) orifice and 3 nozzles each having a 6/32 inch diameter orifice. The total orifice area is approximately the same. The total flow rate was kept the same at 114 gal/min, equating to approximately 38 gal/min through the 6/32 inch nozzles and 19 gal/min through the 4/32 inch nozzles. Pressure drop across individual nozzles was 2500 psi in each case. Other factors such as the standoff, the number, size and pattern of perforations, the fluid properties, etc, were kept the same for each run. FIG. 6 shows a comparison of the volume of debris displaced from the annulus (expressed the volume of debris remaining in the annulus as a percentage of the total volume) vs time.

In further runs using the washing CFD model, the inventors experimented with varying the number of upward and downward movements of the tool. The current qualified technique involves making several passes up and down. The CFD model clearly showed that running the wash tool up the modelled section of well was rather ineffective since debris from the displaced annulus content was continually falling back into the washed region under the effect of gravity. This was shown by the percentage of displaced material in the annulus vs time.

Furthermore, the CFD work showed that the washing effect of a downward pass of the wash tool could be at least partly negated by a subsequent pass of the wash tool up the well/casing. Repeated downward passes of the wash tool, with no wash fluid being passed from the tool on the intervening upward travel of the tool, was much more effective. Even one downward pass of the wash tool whilst emitting wash fluid was indicated by the CFD results to be effective.

In another run, a comparison was made of rotational speeds. The comparisons made in these runs were made using the cementing model; the inventors had wanted to investigate whether varying the standard qualified rotation rate of 80 r.p.m. for cementing would produce better results, but instead discovered that washing at higher rotational speeds was more effective. See Example 4 below for more details of the model. Since both Example 3 and Example 4 are essentially measures of the energy of the flow in the annulus, and since the modelled properties of mud and cement are reasonably similar, the inventors believe that the results from these cementing tests are also relevant to wash fluid (mud).

Figure 7A:
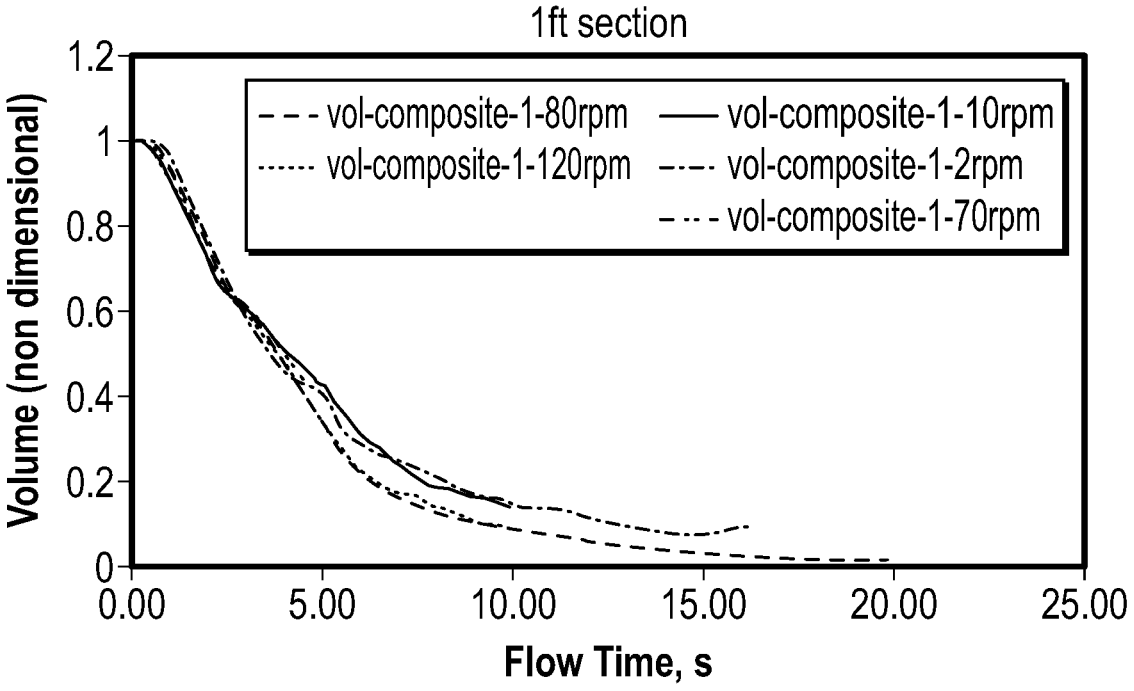
FIG. 7*a* is a graphic result from CFD testing showing a comparison between different rotation rates.
Figure 7B:
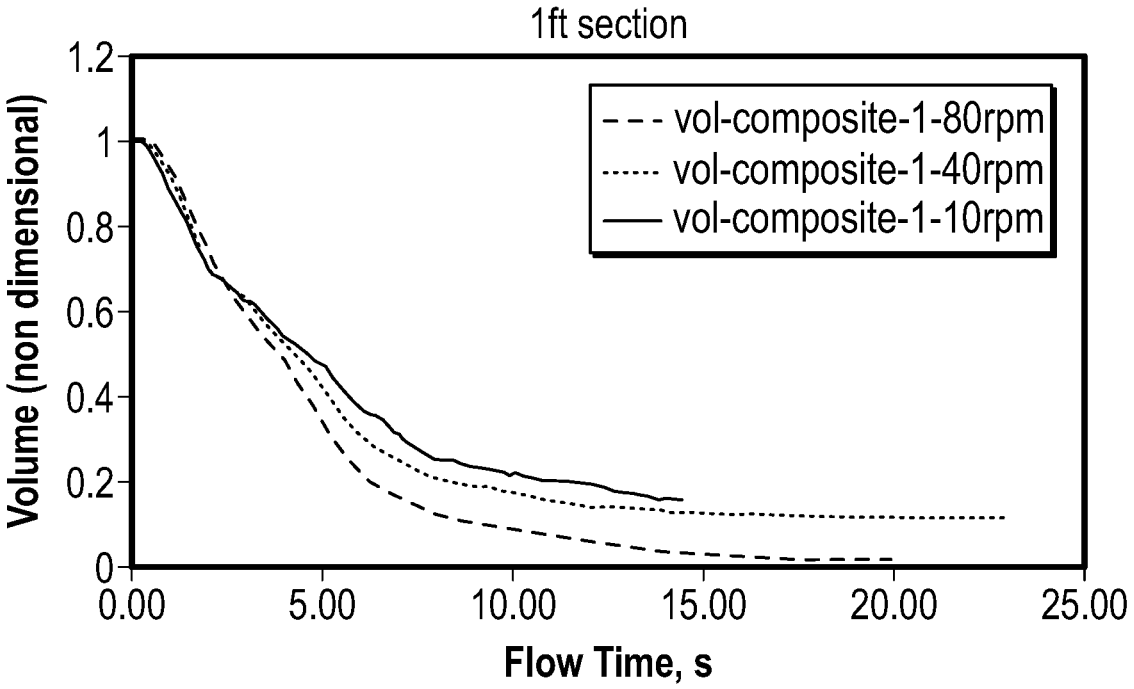
FIG. 7*b* is a graphic result from further CFD testing showing a comparison between different rotation rates.

FIGS. 7*a* and 7*b* show the results of CFD tests on cementing operations using different rotational speeds. The graphs in FIGS. 7*a* and 7*b* are of displaced annulus volume expressed as a percentage, vs time. In these models the initial annulus volume would be assumed to be wash fluid (drilling mud).

FIG. 7*a* shows the results for rotation speeds of 2, 10, 70, 80 and 120 r.p.m. The 2 and 10 r.p.m. results can be seen to be significantly less effective than the runs at 70, 80 and 120 r.p.m. The inventors found this surprising because the reason for the current qualified cementing technique using an 80 r.p.m. rotation rate is to drive an augur type device intended to pressurize the cement to "squeeze" it through the perforations. In terms of effective jetting, it had been assumed that a slower rotational speed would be more effective. The current qualified wash process, in contrast to the cementing process, involves rotation at about 6-10 r.p.m. which was thought to be necessary to allow a jet of wash fluid to be directed more effectively through the perforations. The inventors had been seeking to lower the rate of rotation for a cement job and to optimize parameters for creation of pressure pulses of cement in the annulus, but instead found unexpectedly that the 80 r.p.m. rotation rate was more effective at energizing the annulus content.

It appeared from the results in FIG. 7*a* that there was little difference between 70 r.p.m. and 120 r.p.m. so the inventors sought to establish what happened at speeds between 10 and 70 r.p.m. Further tests were carried out, with representative results shown in FIG. 7*b*, which showed that increasing the speed from 10 to 40 r.p.m. resulted in a significant improvement, but that 80 r.p.m. produced even better results than 40 r.p.m.

The inventors have not yet had the opportunity to try r.p.m. changes in the wash fluid model but are confident that the results would be similar, since the viscosities and densities of the cement and the mud are broadly similar.

In summary, the surprising findings of this work on the wash process were: (i) the beneficial effect of a high rotation speed: (ii) the fact that moving the tool downwards during the wash process provided a much more effective wash than moving the tool upwards, and indeed that moving the tool upwards whilst washing may even negate the washing effect of a preceding downward wash; and finally (iii) that the use of a higher pressure drop across each nozzle and higher volume flow rate through each nozzle (even with the same total flow and thus a smaller number of nozzles) was more effective to ensure that the annulus content was energized and moved.

Example 4

A further batch of CFD tests was run to explore the injection of cement from a cementing tool within a perforated casing. The model was similar to that for the washing process as described above, but the cementing tool has different nozzles, the overall flow rate for cement is different to that for wash fluid (mud) and the content of the annulus is assumed to be wash fluid (mud).

The standard qualified cementing technique uses 4⅝32 inch diameter nozzles and a total flow rate of cement of about 100 gal/min, making the flow rate through each nozzle about 25 gal/min. The cementing tool is normally pulled upwardly through the casing at a rate of about 6 feet per minute and the tool is rotated at 80 r.p.m. An 18 hole per inch perforation pattern is normally used, giving a total open area of about 3.9%. A CFD analysis was performed of the technique using these parameters.

A further CFD run was performed using only 2⅝32 inch nozzles and a slightly higher total flow rate of 134 gal/min, giving a flow rate per nozzle of about 67 gal/min. A 20 hole perforation pattern giving about 4.7% open area was modelled, and the rate of moving the cementing head through the tube was set at 9 feet per minute, with a rotation speed of 80 r.p.m.

Figure 8:
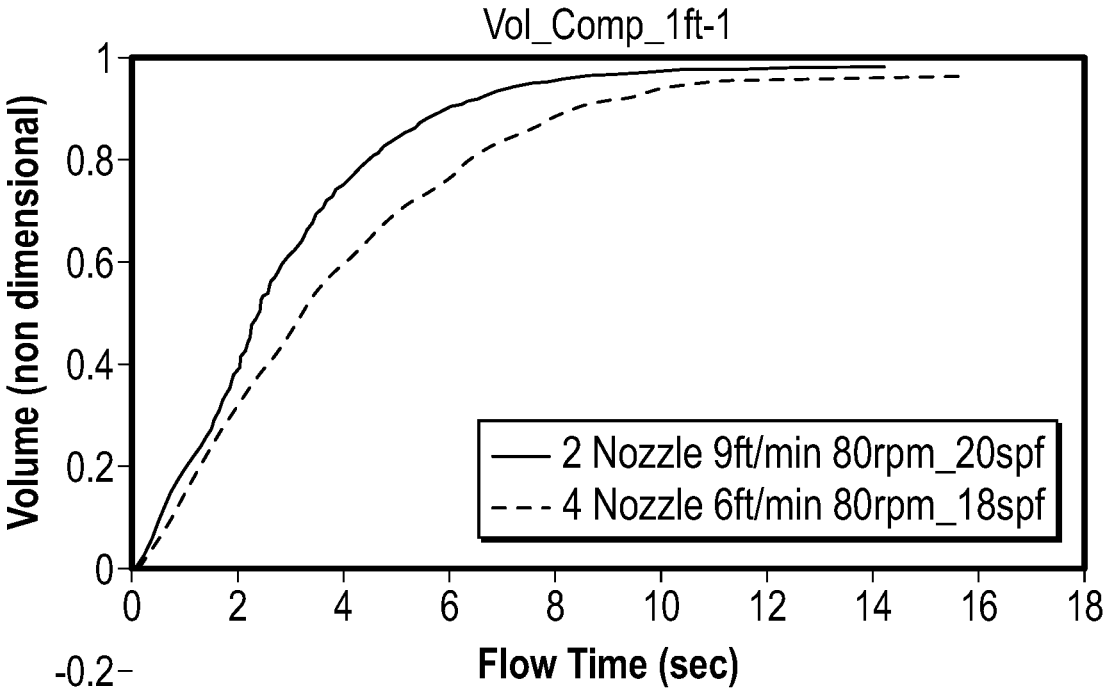
FIG. 8 is a graphic result from CFD testing showing a comparison between a cement process using 4 8/32" nozzles vs a process using 2 8/32" nozzles.

FIG. 8 is a graph of the results, in terms of the volume of the annulus filled occupied by cement (expressed as a percentage) vs time. It can easily be seen that the run with 2 nozzles produced considerably better results. Although the results are not strictly comparable because other conditions have been changed, the inventors believe that the negative effect of the higher pull rate of 9 feet per minute may have approximately compensated for the overall higher flow rate and higher open area percentage. The inventors believe that the key to the improved result is the higher volume flow rate per nozzle (and hence higher pressure drop per nozzle), which the inventors believe will more effectively energise the annulus content. A further benefit appears to be that a higher rate of pulling the cementing tool through the casing is possible, saving time in the operation.

Example 5 (Comparative)

The parameters for some plug and abandon jobs performed in the North Sea are reproduced in Table 2 below. The parameters for these specific jobs are similar to many others performed by the applicant and its contractors. For many of these jobs the cement inside the casing had been drilled out and a sonic logging tool passed down the casing to assess the quality of the cement in the annulus. Whilst the cement job in most cases has been sufficiently good not to require a new plug to be put in place, in general the sonic log has revealed cement which is of lower quality (in terms of density and hardness) than is desired.

TABLE 2

| Casing ID (in) | Tool OD (in) | Washing nozzle sizes and number of each nozzle size (in) | Cementing nozzle sizes and number of each nozzle (in) | Nozzle stand off (in) | Rotation (RPM) | Cement total flow (gpm) | Wash fluid total flow (gpm) | Pulling speed ft/min |
|---|---|---|---|---|---|---|---|---|
| 8.535 | 8.00 | 23 × 4/32" 7 × 5/32" | 4 × 8/32" | 0.27 | 6RPM washing; 80 RPM cementing. | 100 | 280-450 | 0.5 (wash-up and down) 7 (cement) |
| 8.535 | 7.00 | 25 × 4/32" | 4 × 8/32" | 0.77 | 6 RPM washing; 80 RPM cementing. | 100 | 450 | 0.4 (wash-down) 0.5 (wash-up) 7 (cement) |

Example 6 (Comparative)

A further job was conducted in a severely constricted well. The parameters used are presented below in Table 3. Because of the constriction a small tool was used in order to get past the restriction, which meant there was a larger standoff (distance between the tool and the inner surface of the casing). The figure in the table for stand off is calculated as half the difference between the tool outer diameter and the casing inner diameter. The well was not drilled out and logged because of the constriction and so it was not determined whether the quality of the job was acceptable or not. Because the tool was small, a smaller number of nozzles with a larger orifice size was used.

Because of the small number of larger nozzles used, the flow rate per nozzle was about 32 gpm and the pressure drop over each nozzle was estimated at 3500 psi. However, since the standoff was large, it is believed that the job may well not have been effective. However, this cannot be verified because it was not drilled out and logged.

TABLE 3

| Casing ID (in) | Tool OD (in) | Wash nozzle sizes and number of each nozzle size (in) | Cement nozzle sizes and number of each nozzle size (in) | Nozzle stand off (in) | Rotation (RPM) | Cement total flow rate (gpm) | Wash fluid total flow rate (gpm) | Pulling speed (ft/min) |
|---|---|---|---|---|---|---|---|---|
| 8.535 | 5.50 | 14 × 5/32" | 4 × 8/32" | 1.52 | 6 RPM washing; 80 RPM cementing. | 100 | 450 | 0.2 (wash-down) 0.5 (wash-up) 7 (cement) |

Example 7 (Comparative)

A plug and abandon job was performed on a well in the North Sea using both the current accepted/qualified technique for one plug and a technique according to the invention for another plug in the same well. The parameters for the jobs are given in Table 4 below. The bore was drilled out and the cement job in the annulus assessed using a sonic cement bond logging tool. The output from the logging tool is not a numerical one but a graphic which shows where the cement is hard/well bonded to the wellbore and casing. The logs from these jobs were interpreted by an expert and the cement in the plug according to the invention was judged to be of substantially better quality than the plug set with the prior art technique. In addition, for a number of reasons the technique according to the invention was much quicker to carry out.

TABLE 4

| | Wash | | Cement | |
|---|---|---|---|---|
| Parameter | Qualified (old) | New | Qualified (old) | New |
| Passes | Multiple (up/down) | Single (top to bottom) | Single | Single |
| Nozzles | 30 (23 × 4/32" & 7 × 5/32") | 10 × 6/32" | 4 × 8/32" | 2 × 8/32" |
| Flow rate | 15 g.p.m. per nozzle | 38 g.p.m. per nozzle | 25 g.p.m. per nozzle | 67 g.p.m. per nozzle |
| Translation speed | 1 ft/min | 1 ft/min | 6 ft/min | 9 ft/min |
| Rotation speed | 6 r.p.m. | 80 r.p.m. | 80 r.p.m. | 120 r.p.m. |
| Perforations | 18/foot 1" perfs (3.7% open area) | 20/foot 1.4" perfs (4.9% open area) | 18/foot 1" perfs (3.7% open area) | 20/foot 1.4" perfs (4.9% open area) |

Example 8

Further CFD tests similar to Examples 3 and 4 were conducted for washing and cementing, using models both of industry standard 9% inch casing and also industry standard 10¾ inch casing. Based on this further analysis the optimum values for the various parameters were selected and are presented in Table 5 below. Because the values for these two standard casing sizes were very similar, the inventors believe the results for industry standard 7¾ inch casing would also be very similar and therefore within the claimed ranges for the various parameters.

TABLE 5

| | | |
|---|---|---|
| Casing size (OD) | 10¾" | 9⅝" |
| Cement volume | 100 bbl | 100 bbl |
| WASH nozzles | 10 × 6/32 | 10 × 6/32 |
| Flow over nozzle, WASH | 38 gpm, 2500 Psi pressure drop | 38 gpm, 2500 Psi pressure drop |
| Cement Nozzles | 3 × 7/32 | 2 × 8/32 |
| Flow over nozzle, Cement | 52 gpm, 2500 Psi pressure drop | 69 gpm, 2500 Psi pressure drop |
| WASH rpm and translation speed | 80 rpm, 1 ft/min | 80 rpm, 1 ft/min |
| CEMENT rpm and translation speed | 150 rpm, 8.2 ft/min | 120 rpm, 7 ft/min |

Example 9 (Comparative)

A PWC operation by another operator in the Norwegian North Sea was deemed unsuccessful after logging. The parameters used in this PWC operation were shared with the applicant by the other North Sea operator. In this comparative example these parameters were used in the CFD model to perform a simulation of this North Sea PWC operation.

TABLE 6

| Casing diameter (in) (ID) | Tool OD (in) | Wash nozzle sizes and number of each nozzle size (in) | Cement nozzle sizes and number of each nozzle size (in) | Nozzle pressure (psi) | Rotation (RPM) | Cement total flow rate (gpm) | Wash fluid total flow rate (gpm) | Pulling direction |
|---|---|---|---|---|---|---|---|---|
| 9% (OD) 8.54 (ID) | 5.50 | 30x mix of 4/32" and 5/32" | 4 × 8/32" | 1700 (wash) 430 (cement) | 6-10 RPM washing; 80 RPM cementing. | 106 | 528 | Wash: up & down Cement: up |

The CFD results showed poor displacement by wash fluid and cement, consistent with the poor results obtained in the North Sea.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication date after the priority date of this application. Incorporated references are listed again here for convenience: Ferg, T., et al "Novel Techniques to More Effective Plug and Abandonment Cementing Techniques", *Society of Petroleum Engineers Artic and Extreme Environments Conference*, Moscow, 18-20 Oct. 2011 (SPE #148640).

The invention claimed is:

1. A method of performing a downhole wash procedure in an offshore well in a region of casing having perforations or other openings, the method comprising:

passing a washing tool down the casing to the region with perforations or openings, the washing tool having a plurality of nozzles and being connected to a supply of wash fluid;

delivering wash fluid through the nozzles whilst rotating the washing tool and translating the washing tool in an axial direction with respect to the casing, such that wash fluid is forced through the perforations and pulses of pressure are created in an annulus between the casing and the rock formation of the wellbore, thereby displacing debris in the annulus to wash fluid; wherein:

the rotation speed of the wash tool whilst delivering wash fluid is from 70 r.p.m. to 120 r.p.m.

2. The method according to claim 1, wherein, whilst delivering wash fluid, the translational movement of the washing tool is in a downward (distal) direction only.

3. The method according to claim 2, wherein the wash fluid is delivered in a single downward (distal) pass of the washing tool.

4. The method according to claim 2, wherein the rate of downward movement is from 0.1 feet/min to 4 feet/min.

5. The method according to claim 2, characterised in that the rate of downward movement is selected from approximately 0.1 feet/min, 0.2 feet/min, 0.3 feet/min, 0.4 feet/min, 0.5 feet/min, 0.6 feet/min, 0.7 feet/min, 0.8 feet/min, 0.9 feet/min, 1 foot/min, 1.2 feet/min, 1.4 feet/min, 1.5 feet/min, 1.6 feet/min, 1.8 feet/min, 2 feet/min, 2.2 feet/min, 2.4 feet/min, 2.6 feet/min, 2.8 feet/min, 3 feet/min, 3.2 feet/min, 3.4 feet/min, 3.6 feet/min, 3.8 feet/min, 4 feet/min, including from about 0.1 feet/min to 4 feet/min, between 0.5 feet/min and 2 feet/min, and about 1 foot/min.

6. The method according to claim 1, wherein, whilst delivering wash fluid, the perpendicular distance from an outlet of each nozzle to an interior wall of the casing is from 0.1 inch to 1 inch.

7. The method according to claim 1, wherein:

a. the volume flow rate of wash fluid through each nozzle is from 28 to 50 g.p.m.; and b. the pressure drop across each nozzle is from 2,000 to 4,000 p.s.i.

8. The method according to claim 1, wherein the wash fluid is drilling mud having a density from 8 to 17 pounds per gallon.

9. The method according to claim 1, wherein the wash fluid is drilling mud having a viscosity from 10 to 60 cP.

10. The method according to claim 1, wherein the overall volume flow rate of wash fluid is from 180 gal/min to 500 gal/min.

11. The method according to claim 1, wherein the washing tool has between 5 and 20 nozzles, each having an approximately circular orifice with a diameter of 5/32 inch to 8/32 inch (3.97 to 6.35 mm).

12. The method according to claim 1 wherein said volume flow rate of wash fluid through each nozzle is selected from approximately 28 g.p.m., 29 g.p.m., 30 g.p.m., 31 g.p.m., 32 g.p.m., 33 g.p.m., 34 g.p.m., 35 g.p.m., 36 g.p.m., 37 g.p.m., 38 g.p.m., 39 g.p.m., 40 g.p.m., 41 g.p.m., 42 g.p.m., 43 g.p.m., 44 g.p.m., 45 g.p.m., 46 g.p.m., 47 g.p.m., 48 g.p.m., 49 g.p.m., 50 g.p.m., including from 28 to 50 g.p.m., and from 33 to 45 g.p.m.

13. The method according to claim 1 wherein said pressure drop across each nozzle is selected from approximately 2,000 p.s.i., 2,250 p.s.i., 2,500 p.s.i., 2,750 p.s.i., 3,000 p.s.i., 3,250 p.s.i., 3,500 p.s.i., 3,750 p.s.i., 4,000 p.s.i., from 2,000 to 4,000 p.s.i., and from 2,000 to 3,000 p.s.i.

14. The method according to claim 1, characterised in that the rotation speed of the wash tool whilst delivering wash fluid is selected from approximately 90 r.p.m., 100 r.p.m., 110 r.p.m., 120 r.p.m., 130 r.p.m., 140 r.p.m., 150 r.p.m.

15. The method according to claim 1, characterised in that the wash fluid is drilling mud having a density selected from approximately 8 pounds per gallon, 9 pounds per gallon, 10 pounds per gallon, 11 pounds per gallon, 12 pounds per gallon, 13 pounds per gallon, 14 pounds per gallon, 15 pounds per gallon, 16 pounds per gallon, 17 pounds per gallon, from 8 to 17 pounds per gallon, and from 9 to 16 pounds per gallon.

16. The method according to claim 1, characterised in that the wash fluid is drilling mud having a viscosity selected from approximately 10 cP, 20 cP, 30 cP, 40 cP, 50 cP, 60 cP, from 10 to 60 cP, and from 20 to 50 cP.

17. The method according to claim 1, characterised in that the overall volume flow rate of wash fluid is selected from approximately 180 gal/min, 190 gal/min, 200 gal/min, 210 gal/min, 220 gal/min, 230 gal/min, 240 gal/min, 250 gal/min, 260 gal/min, 270 gal/min, 280 gal/min, 290 gal/min, 300 gal/min, 310 gal/min, 320 gal/min, 330 gal/min, 340 gal/min, 350 gal/min, 360 gal/min, 370 gal/min, 380 gal/min, 390 gal/min, 400 gal/min, 410 gal/min, 420 gal/min, 430 gal/min, 440 gal/min, 450 gal/min, 460 gal/min, 470 gal/min, 480 gal/min, 490 gal/min, 500 gal/min, from 180 gal/min to 500 gal/min, and from 280 gal/min to 450 gal/min.

18. The method according to claim 1, wherein the washing tool has between 5 and 20 nozzles, or more, each having an approximately circular orifice with a diameter selected from approximately 5/32 inch (3.97 mm), 6/32 inch (4.76 mm), 7/32 inch (5.56 mm), 8/32 inch (6.35 mm), from 5/32 inch to 8/32 inch (3.97 to 6.35 mm), and from 6/32 inch to 7/32 inch (4.76 to 5.56 mm).

19. The method according to claim 1, wherein wash fluid is delivered through a plurality of nozzles selected from approximately 6 nozzles, 7 nozzles, 8 nozzles, 9 nozzles, 10 nozzles, 11 nozzles, 12 nozzles, 13 nozzles, 14 nozzles, 15 nozzles, 16 nozzles, 17 nozzles, 18 nozzles, 19 nozzles, 20 nozzles, from 6 to 20 nozzles, and from 8 to 15 nozzles.

* * * * *